US005450639A

United States Patent [19]

Weismiller et al.

[11] Patent Number: 5,450,639

[45] Date of Patent: Sep. 19, 1995

[54] ELECTRICALLY ACTIVATED VISUAL INDICATOR FOR VISUALLY INDICATING THE MODE OF A HOSPITAL BED CASTOR

[75] Inventors: Matthew W. Weismiller, Batesville; Kenneth L. Kramer, St. Paul, both of Ind.

[73] Assignee: Hill-Rom Company, Inc., Batesville, Ind.

[21] Appl. No.: 171,006

[22] Filed: Dec. 21, 1993

[51] Int. Cl.[6] ..... A61G 7/00

[52] U.S. Cl. ..... 5/600; 5/424; 16/35 R; 188/1.12

[58] Field of Search ..... 188/1.11 R, 1.11 E, 188/1.12; 16/18, 35 R; 5/600, 86.1, 424

[56] References Cited

U.S. PATENT DOCUMENTS

| | | | |
|---|---|---|---|
| 3,409,105 | 11/1968 | Clinton | 188/1.12 X |
| 3,890,668 | 6/1975 | Stosberg et al. | 16/35 |
| 4,175,783 | 11/1979 | Pioth | 188/1.12 X |
| 4,276,962 | 7/1981 | Aulik | 16/35 R |
| 4,300,791 | 1/1982 | Aulik | 16/35 R |
| 4,778,164 | 10/1988 | Mueller et al. | 5/600 |
| 4,941,552 | 6/1990 | Screen | 16/35 R X |
| 5,181,587 | 1/1993 | Masatoshi | 188/1.11 R X |
| 5,328,100 | 7/1994 | Butter et al. | 188/1.11 R X |
| 5,377,372 | 1/1995 | Rudolf et al. | 16/35 R X |
| 5,383,531 | 1/1995 | Butter et al. | 188/1.11 R X |

OTHER PUBLICATIONS

1992 Brochure "Centra From Hill-Rom".

1993 Brochure "The Advance 2000 Bed".

*Primary Examiner*—Richard Trettel

*Attorney, Agent, or Firm*—Barnes & Thornburg

[57] ABSTRACT

An electrically activated visual indicator for visually indicating the status of a castor of a hospital bed comprising a flashing light emitting diode (LED) contained within and visible through a foot pedal that is connected to a positioning mechanism for selectively placing at least one castor of the hospital bed into a brake, neutral or steer mode, wherein the flashing LED is activated when the castor is in either the neutral or steer mode and is deactivated when the castor is in the brake mode.

20 Claims, 2 Drawing Sheets

ELECTRICALLY ACTIVATED VISUAL INDICATOR FOR VISUALLY INDICATING THE MODE OF A HOSPITAL BED CASTOR

FIELD OF THE INVENTION

This invention relates generally to hospital beds. More particularly, this invention relates to an electrically activated visual indicator for visually indicating the mode of a hospital bed castor, and more specifically, for visually indicating when a hospital bed castor is in an unbraked mode.

BACKGROUND OF THE INVENTION

Hospital beds, whether of the medsurg type, stretcher type or birthing type, have typically been provided with castors mounted around the base for movement of the bed. At least one of the castors, and usually two, have at least two operating modes. In most cases, one of the castors will have three operating modes.

More particularly, where the hospital bed castor(s) has (have) two operating modes, these are known as "neutral" and "brake". In the neutral mode, the castors are free to swivel about their respective vertical axes. In the brake mode, the brake castor pad is pressed against the surface of the castor wheel to prevent it from rotating. Further, one of the castors will frequently have a third mode, known as the "steer" mode, in which the castor is locked against swivelling movement and is aligned parallel to the longitudinal dimension of the bed (castor axis of rotation is perpendicular to the hospital bed longitudinal dimension) such that the bed can be pushed straight down a hallway without the bed drifting to one side or the other.

Typically, hospital beds include a rotatable pedal operatively connected to the castor(s) by a linkage or other castor positioning system (e.g., cable drive or the like) for placing the castors in the neutral, brake and steer modes. Normally, the pedal, when in a centermost position, corresponds to the castor being in its neutral mode. The care provider, by stepping on the pedal and rotating it in a first direction from neutral, places the bed into the steer mode for straight-line tracking down the hallway. Alternately, by stepping on the pedal and rotating it in a second direction from neutral, the care provider places the bed into the braked mode, thus making the bed stable for patient ingress and egress. The care provider must, from time to time, check the pedal to ensure that the linkage has in fact engaged the brake when desired. This can be done either by observing the position of the pedal, which can be less than positive visual indication, or, as is more likely, by manually checking the position of the pedal by repeatedly pressing the pedal with a foot. However, this can be time consuming for the care provider. Thus, there has been a significant need for a device that positively visually indicates to the care provider the status of the hospital bed castors as controlled by the pedal and associated linkage.

SUMMARY OF THE INVENTION

The present invention provides an electrically activated visual indicator adapted to positively visually indicate to the care provider when the castor(s), as controlled by the pedal and associated castor positioning system of a hospital bed, is not in a braked mode and, thus, unstable for patient ingress and egress. To this end, and in accordance with the principles of the present invention, there is provided a hospital bed comprising a base, a patient support mounted above the base, castors mounted around the base and including at least one castor having a brake mode and at least one of neutral and steer modes, a castor positioning system for selectively positioning the at least one castor in each of the modes, an actuator for manual movement of the castor positioning system and an electrically activated visual indicator that is responsive to movements of the actuator for visually indicating the mode of the at least one castor.

The electrically activated visual indicator preferably comprises a normally closed switch electrically connected to a power supply, means operably associated with the actuator and the switch for placing the switch in open and closed conditions, and a visual display device electrically connected to the switch. It is contemplated that the normally closed switch will be in a closed condition, and the visual device activated, when the at least one castor is in either the neutral or steer mode.

The care provider actuating structure is preferably a foot pedal rotatably connected by a shaft to the positioning mechanism for foot activation of the positioning mechanism by rotation of the shaft in first and second directions. Further, the positioning mechanism is preferably a linkage type system. Still further, the visual display device is preferably a light emitting diode that is mounted on the foot pedal.

The operably associated means preferably comprises a roll pin extending radially outward from the shaft of the pedal and a switch arm extending from the normally closed switch. The roll pin and switch are positioned such that the roll pin releases the switch arm, and permits the switch to return to its normally closed condition, when the shaft is rotated in the first direction, placing the selectable castor in the neutral or steer mode. Further, the roll pin depresses the switch arm, and places the switch in an open condition, when the shaft is rotated in the second direction, placing the selectable castor in the brake mode.

The present invention provides numerous advantages. The visual display device provides a quick and easy means for alerting the care provider when the at least one castor is in the brake mode, and thus stable for patient ingress and egress. In addition, placement of the visual device within and visible through the brake pedal provides a convenient and observable location that, by its very location, serves to remind the care provider when the selectable castor is not in the braked mode.

These and other objects and advantages of the present invention shall be apparent from the accompanying drawings and descriptions thereof.

BRIEF DESCRIPTION OF THE DRAWINGS

The accompanying drawings which are incorporated in and constitute a part of this specification, illustrate an embodiment of the invention and, together with a detailed description of the invention given below, serve to explain the principles of the present invention.

DETAILED DESCRIPTION OF THE INVENTION

Figure 1:
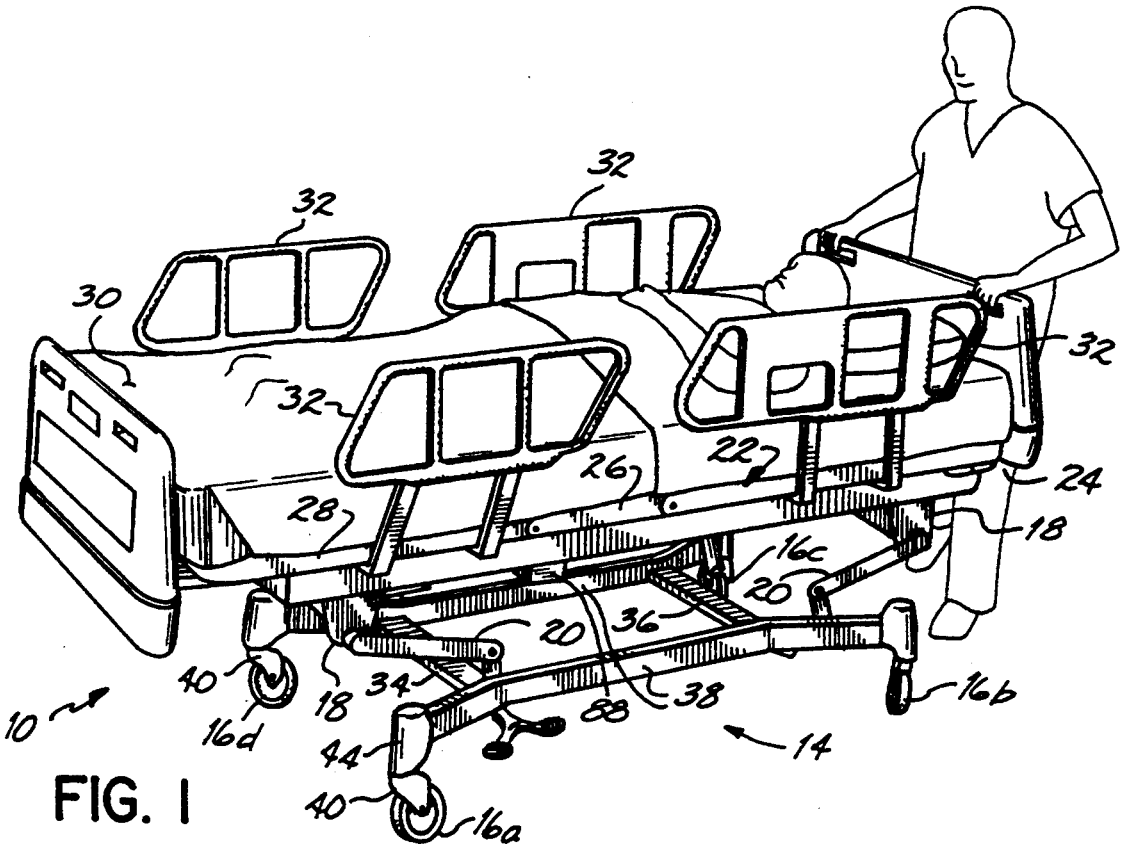
FIG. 1 is a perspective view of a hospital bed including an electrically activated hospital bed castor visual indicator in accordance with the principles of the present invention.

Referring to FIG. 1, a hospital bed 10 is shown having a base 14 with castors 16*a–d* providing rolling support. An intermediate frame 18 is supported on base 14 by a parallelogram linkage 20. A main frame 22 is pivotally connected to intermediate frame 18 by means not shown. A head panel 24, seat panel 26, and footrest 28 are mounted on main frame 22 and form a deck upon which a mattress 30 is placed. Side guards 32 are mounted on either side of hospital bed 10. Base 14 includes transverse beams 34, 36 that are the primary structural elements tying interconnecting longitudinal rails 38 to form base 14.

Figure 2:
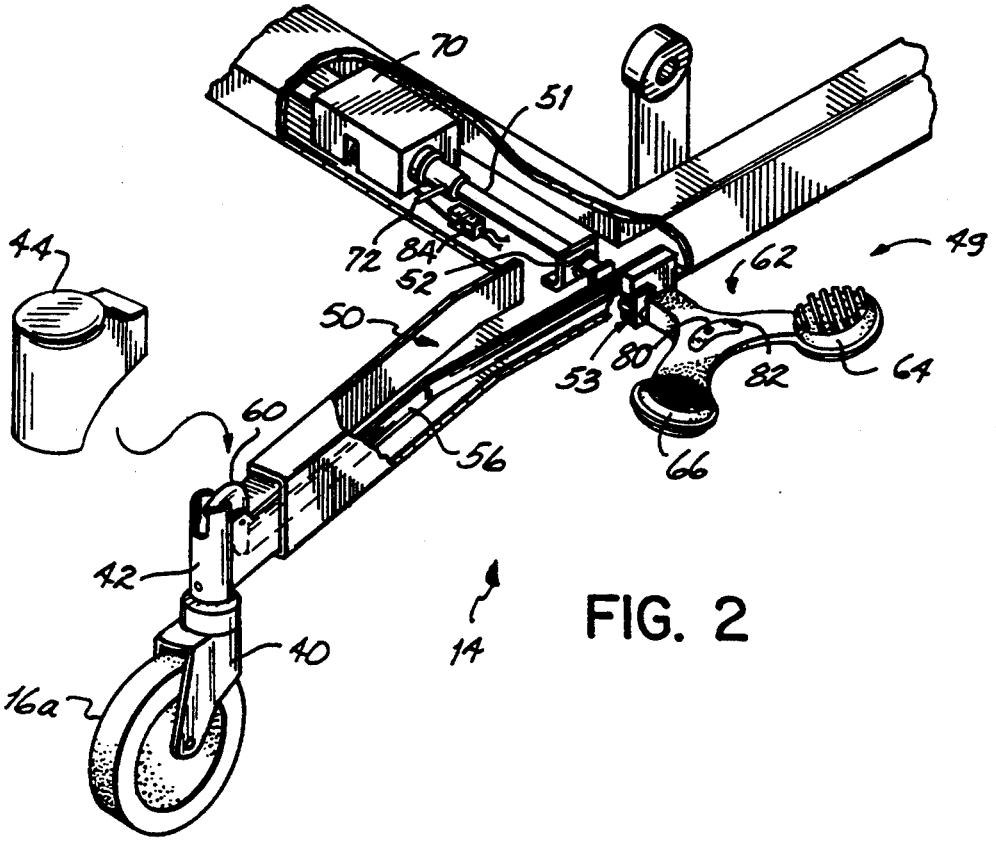
FIG. 2 is an enlarged partial perspective view of the electrically activated visual indicator of FIG. 1.

With reference to FIGS. 1 and 2, each of the castors 16*a–d* is mounted within a yoke 40 that is in turn mounted for swiveling movement within a socket 42 on each end of each rail 38. An end cap 44 covers the socket 40. Castors 16*b* and 16*d* are conventional swivel castors, while castor 16*a* is that type of castor known as a "plunger" type castor having "neutral", "brake" and "steer" functions, and castor 16*c* is also a plunger type castor but having only the aforementioned neutral and brake modes or functions. The neutral, brake and steer functions will be described subsequently in more detail. It will be appreciated that bed 10 could be provided with more than one neutral/brake castor and/or more than one neutral/brake/steer castor. However, ordinarily the bed 10 is provided with just one neutral/brake castor and with just one neutral/brake/steer castor. It will of course be appreciated that the neutral/brake/-steer castor could be placed at 16*c*, and the neutral/-brake castor at 16*a*, without departing from the spirit or scope of the present invention. Further, it will be appreciated that the neutral/brake/steer castor could be replaced by a neutral/brake castor. Still further, it will be appreciated that other types of castors, other than "plunger" type castors, could successfully be employed in the practice of the present invention, for example, "cam" type castors and others.

In a "plunger" type of castor, the castor spindle is spring loaded upwardly and normally maintains the castor locked in the steer mode. Depressing the spindle through a first displacement frees the castor from its steer mode and places it into its free-to-swivel neutral mode. Depressing the spindle through a second displacement places the castor in its brake mode by forcing second displacement places the castor in its brake mode by forcing the castor brake against the castor wheel thereby stopping castor wheel rotation.

Hospital bed 10 includes a positioning mechanism 49 for selectively placing castor 16*a* in neutral/brake/steer mode and for selectively placing castor 16*c* in neutral/-brake mode. The positioning mechanism 49 is a linkage mechanism 50 similar to the linkage system described in pending application Ser. No. 08/041,008 assigned to the assignee of the present invention, the disclosure of which is hereby incorporated by reference herein. However, as will be readily appreciated, other positioning mechanisms, such as, by way of example, a cable activating system, and others, could be used and clearly fall within the spirit, scope and principles of the present invention.

Figure 2A:
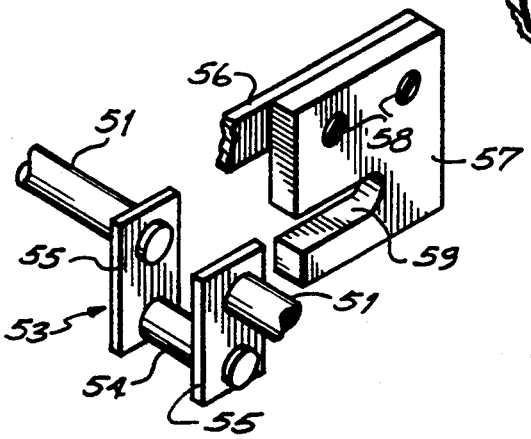
FIG. 2A is a perspective view, exploded and greatly enlarged, of the cam and cam follower of the linkage of the electrically activated visual indicator of FIG. 2.

Referring to FIGS. 2 and 2A, linkage mechanism 50 comprises a shaft 51 located in transverse beam 34, the outwardmost end of which is rotatably supported in a bracket 52 mounted within one of longitudinal rails 38. Outboard of bracket 52, shaft 51 includes a cam 53 that takes the form of a crank 54 offset from and secured to shaft 51 by a pair of spacers 55, 55. Cam 53 cooperatively engages one end of a link 56, which is positioned within one of longitudinal rails 38, by way of an end plate 57 that is connected to link 56 with fasteners 58. Plate 57 has a notch 39 therein which, when assembled, cooperates with crank 54 of cam 53, the operation of which will be more fully described below. The other end of link 56 has a rocker arm 60 pivotally connected thereto that is, in turn, connected to an upwardly spring-loaded plunger or spindle (not shown), of castor 16*a*, the operation of which will be described below.

A pedal 62 is connected to the outboardmost end of shaft 51 and includes a pair of footpads 64, 66. With pedal 62 in the horizontal position, castor 16*a* is said to be in its neutral position, which means the castor yoke 40 may swivel freely with respect to socket 42.

By depressing footpad 64 of pedal 62 downwardly, rotating shaft 51 in a first direction, cam 53 moves crank 54 out of slot 59, allowing the upwardly spring-loaded spindle to move up to the steer position. This places castor 16*a* in the steer mode in that the castor wheel is not free to swivel, but rather, yoke 40 is fixed relative to socket 42, the axis of rotation of the castor wheel is itself being maintained perpendicular to the longitudinal axis of the bed thereby allowing a care provider to push the bed 10 in a straight line down a hallway without the bed drifting to either side.

Depressing food pad 66 downwardly, rotating shaft 51 in a second direction and placing pedal 62 in its horizontal position, returns castor 16*a* to its neutral mode by virtue of crank 54 moving against slot 59 to move link 56 to the right, thereby rotating rocker arm 60 which, in turn, depresses the spindle. Depressing footpad 66 downwardly beyond the horizontal position causes cam 53 to further translate crank 54 against slot 59 to move link 56 further to the right, thereby rotating rocker arm 60 and further depressing the spindle of castor 16*a*, forcing a castor brake pad (not shown) to contact the wheel surface. This places castor 16*a* in the brake mode in that the castor wheel is not free to rotate. Returning pedal 62 to its horizontal position returns the plunger and castor 16*a* to their neutral mode.

A similar structure is used for placing castor 16*c* into the neutral and brake modes. However, castor 16*c* is in its neutral mode when pedal 62 is both in its horizontal position and when footpad 64 is depressed, and is in its brake mode when footpad 66 is depressed.

The inwardmost end of shaft 51 is rotatably secured to detent mechanism 70. Detent mechanism 70 maintains shaft 51 in the three respective angular positions that correspond to the neutral, brake and steer modes of castor 16*a* (and the neutral and brake modes of castor 16*c*). Additionally, shaft 51 includes a roll pin 72 extending radially outward therefrom for a purpose to be described below.

Figure 3:
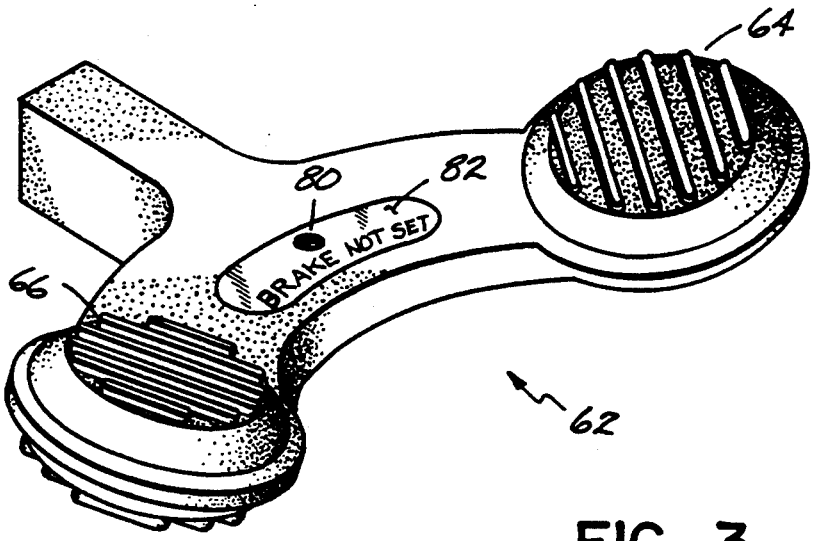
FIG. 3 is an enlarged perspective view of the brake pedal of FIGS. 1 and 2.
Figure 4:
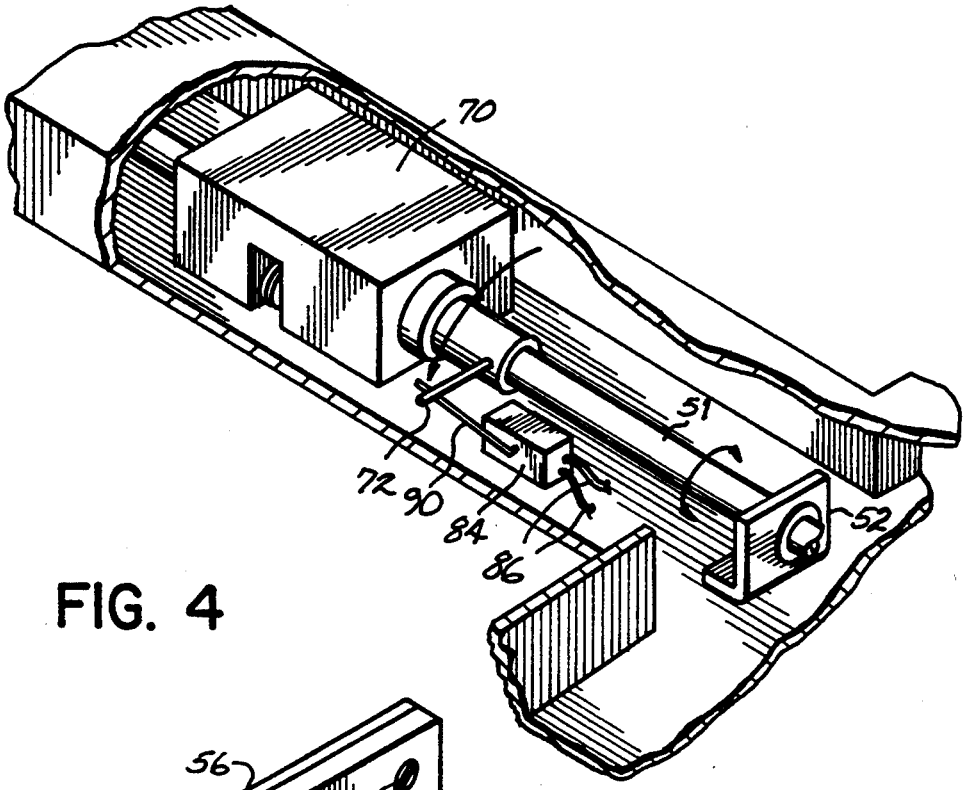
FIG. 4 is an enlarged partial perspective view of the electrically activated visual indicator of FIG. 2.

Referring to FIGS. 2–4, to visually indicate when castors 16*a*, 16*c* are in an unbraked condition, and thus when bed 10 is not stable for patient ingress and egress, a light emitting diode (LED) 80 or other visual device such as, by way of example, a liquid crystal display, is centrally positioned within and visible through pedal 62. Although LED 80 can be located anywhere on hospital bed 10, it has been found advantageous to position it within pedal 62 as it provides a convenient and observable location that, by its very location, serves to remind the care provider when castors 16*a*, 16*c* are not in the braked mode. Further, it has been found beneficial to alternately flash LED 80 on and off when castors 16*a*, 16*c* are in an unbraked mode to more easily alert the care provider. Still further, LED 80 is preferably covered by a plate 82 having the words "BRAKE NOT SET" formed therein such that this message is conveyed to the care provider when castors 16*a*, 16*c* are not in the braked mode and LED 80 is alighted.

LED 80 is activated by a normally closed switch 84 to which it is electrically connected by wires 86. Normally closed switch 84, which is electrically connected to power source 88, is positioned within transverse beam 34 adjacent to shaft 51. A switch arm 90 extends outwardly from switch 84 and is positioned to be operatively engaged by roll pin 72, which extends medially outward from and is press fitted into shaft 51. When pedal 62 is placed in the horizontal position, or footpad 64 is depressed, thus placing castor 16*a* in the neutral or steer mode, roll pin 72 is not in contact with switch arm 90, thereby allowing switch 84 to remain in a closed condition. Closure of switch 84 energizes LED 80 from power source 88 causing LED 80 to alternately flash on and off, alerting the care provider that hospital bed 10 is in an unbraked condition and, thus, unstable for patient ingress and egress. If, however, footpad 66 is depressed, placing castor 16*a* in the brake mode, roll pin 72 is rotated towards, contacts and depresses switch arm 90, thereby placing switch 84 into an open condition and de-energizing LED 80. Thus, the care provider is visually notified that hospital bed 10 is in a braked condition by merely observing that LED 80 is no longer illuminated and, thus, bed 10 is stable for patient ingress and egress.

Although LED 80 has been described as being energized when castor 16*a* is in either the neutral or steer mode, it will be readily apparent that LED 80 can be energized when castor 16*a* is in the brake mode. In this embodiment, plate 82 would be replaced with a plate having the words "BRAKE SET" or other similar words formed therein. Thus, LED 80 would flash on and off when castor 16*a* is in the braked mode, notifying the care provider that bed 10 is stable for patient ingress and egress.

In use, when a patient is to be placed on or removed from hospital bed 10, the care provider moves hospital bed 10 to the desired location. Because hospital bed 10 has been moved, castor 16*a* is in the neutral or steer mode, switch 84 is in a closed condition and LED 80 is flashing to indicate castor 16*a* is not in the braked mode. The care provider, upon visually observing the flashing LED 80 "BRAKE NOT SET" indicator, places castor 16*a* into the braked mode by depressing foot pad 66 of pedal 62, rotating shaft 51. As shaft 51 rotates, roll pin 72 engages and depresses switch arm 90, placing switch 84 into an open condition and de-energizing LED 80 thereby visually indicating to the care provider that castor 16*a* is in a braked condition and, thus, hospital bed 10 is stable for patient ingress or egress. The patient is then placed on or removed from hospital bed 10. To move the patient, the care provider places castor 16*a* into the neutral mode (or steer mode if applicable). The care provider depresses foot pad 64 of pedal 62, which in turn rotates shaft 51 and roll pin 72. Roll pin 72 then disengages switch arm 90 thereby permitting switch 84 to return to its normally closed condition. Closure of switch 84 energizes LED 80 from power source 88, visually indicating to the care provider that castor 16*a* is no longer in a braked mode.

By virtue of the foregoing, there is thus provided an electrically activated visual indicator for visually indicating the mode of the castor(s) of a hospital bed that easily and quickly alerts the care provider when the castor(s) is (are) in an unbraked mode. While the present invention has been illustrated by description of two embodiments, it is not the intention of the applicant to restrict or limit the scope of the appended claims to such detail. Additional advantages will readily appear to those skilled in the art; thus, the invention is not limited to the specific details or apparatus shown and described.

We claim:

1. A hospital bed comprising:

a base;

a patient support mounted above said base;

castors mounted around said base and including at least one castor having a brake mode and at least one of neutral and steer modes;

a positioning mechanism connected to said at least one castor for selectively positioning said at least one castor in said neutral mode and said at least one of brake and steer modes;

an actuator for manual movement by a care provider for actuating said positioning mechanism; and an electrically activated visual indicator for visually indicating said mode of said at least one castor mounted on said actuator, said electrically activated visual indicator being responsive to movements of said actuator.

2. The hospital bed of claim 1 wherein said positioning mechanism is a linkage.

3. The hospital bed of claim 1 wherein said electrically activated visual indicator is activated when said at least one castor is not in said brake mode.

4. The hospital bed of claim 1 wherein said electrically activated visual indicator comprises:

a switch electrically connected to a power supply;

means operably associated with said actuator and said switch for placing said switch into an open or closed condition; and a visual display device electrically connected to said switch, said display device being activated when said switch is in said closed condition.

5. The hospital bed of claim 4 wherein said switch is normally in said closed condition.

6. The hospital bed of claim 5 wherein said actuator comprises a pedal rotatably connected by a shaft to said positioning mechanism for foot activation of said positioning mechanism by rotation of said shaft in first and second directions.

7. The hospital bed of claim 6 wherein said visual display device is mounted on said pedal.

8. The hospital bed of claim 7 wherein said visual display device is a light emitting diode.

9. The hospital bed of claim 6 wherein said operably associated means comprises:

a roll-pin extending radially outward from said shaft; and a switch arm extending from said normally closed switch such that said roll-pin, when moved away from said switch arm, releases said switch arm and permits said switch to return to said normally closed condition when said shaft is rotated in said first direction and said roll-pin, when moved against said switch arm, depresses said switch arm and places said normally closed switch into said open condition when said shaft is rotated in said second direction.

10. A hospital bed comprising:

a base;

a patient support mounted above said base;

castors mounted around said base and including at least one castor having neutral, brake and steer modes;

a linkage mechanism connected to said at least one castor for selectively positioning said at least one castor in said neutral, brake and steer modes;

a brake pedal rotatably connected by a shaft to said linkage for foot activation of said linkage mechanism by rotation of said shaft in first and second directions;

a normally closed switch electrically connected to a power supply;

means operably associated with said pedal and said switch for placing said normally closed switch into an open or closed condition; and a light emitting diode electrically connected to said switch mounted on said pedal, said light emitting diode being energized when said switch is in said closed condition for visually indicating said mode of said at least one castor.

11. The hospital bed of claim 10 wherein said normally closed switch is in said closed condition when said at least one castor is in said neutral and steer modes.

12. The hospital bed of claim 10 wherein said operably associated means comprises:

a roll-pin extending radially outward from said shaft; and a switch arm extending from said normally closed switch such that said roll-pin, when moved away from said switch arm, releases said switch arm and permits said normally closed switch to return to said normally closed condition when said shaft is rotated in said first direction and said roll-pin, when moved against said switch arm, depresses said switch arm and places said normally closed switch into said open condition when said shaft is rotated in said second direction.

13. For a hospital bed having a base and castors mounted around the base including at least one castor having a brake mode and at least one of neutral and steer modes, the base having a positioning mechanism connected to the at least one castor for selectively positioning the at least one castor into the brake mode and the at least one of neutral and steer modes, the positioning mechanism being actuatable by a pedal rotatably connected by a shaft to the positioning mechanism for foot activation of the positioning mechanism by rotation of the shaft in first and second directions, an electrically activated visual indicator for visually indicating the mode of the at least one castor comprising:

a switch electrically connected to a power supply;

means operably associated with the pedal and said switch for selectively placing said switch into an open or closed condition; and a visual display device electrically connected to said switch mounted on the pedal, said display device being activated when said switch is in said closed condition.

14. The electrically activated visual indicator of claim 13 wherein the positioning mechanism is a linkage mechanism.

15. The electrically activated visual indicator of claim 14 wherein said visual display device is a light emitting diode.

16. The electrically activated visual indicator of claim 13 wherein said switch is normally in said closed condition.

17. The electrically activated visual indicator of claim 16 wherein said normally closed switch is in said closed condition when the at least one castor is not in the brake mode.

18. The electrically activated visual indicator of claim 16 further including a roll-pin extending radially outward from the shaft and wherein said operably associated means comprises a switch arm extending from said normally closed switch, said switch arm being depressible by the roll-pin for placing said normally closed switch into said open condition when the shaft is rotated in the second direction.

19. For a hospital bed having a base and castors mounted around the base including at least one castor having neutral, brake and steer modes, the base having a linkage connected to said at least one castor for selectively positioning the at least one castor into the neutral, brake and steer modes, the linkage mechanism being actuatable by a pedal rotatably connected by a shaft to the linkage mechanism for foot activation of the linkage mechanism by rotation of the shaft in first and second directions, an electrically activated visual indicator for visually indicating the mode of the at least one castor comprising:

a normally closed switch electrically connected to a power supply;

means operably associated with the pedal and said switch for placing said normally closed switch into an open condition when the at least one castor is in the brake mode; and a light emitting diode electrically connected to said switch mounted on the pedal, said light emitting diode being energized when said switch is in said closed condition.

20. The electrically activated visual indicator of claim 19 further including a roll-pin extending radially outward from the shaft and wherein said operably associated means comprises a switch arm extending from said normally closed switch, said switch arm being depressible by the roll-pin for placing said normally closed switch into said open condition when the shaft is rotated in the second direction.

* * * * *